US012390055B1

(12) United States Patent
Liu et al.

(10) Patent No.: US 12,390,055 B1
(45) Date of Patent: Aug. 19, 2025

(54) AUXILIARY SUPPORT BAR FOR BATHTUB AND BATHTUB HAVING THE SAME

(71) Applicant: Shenzhen Wenjian Technology Co., Ltd., Shenzhen (CN)

(72) Inventors: Zhi Liu, Shenzhen (CN); Tingting Yin, Shenzhen (CN)

(73) Assignee: Shenzhen Wenjian Technology Co., Ltd., Shenzhen (CN)

( * ) Notice: Subject to any disclaimer, the term of this patent is extended or adjusted under 35 U.S.C. 154(b) by 0 days.

(21) Appl. No.: 19/074,291

(22) Filed: Mar. 7, 2025

(30) Foreign Application Priority Data

Jan. 26, 2025 (CN) ..... 202520176229.4

(51) Int. Cl.
*A47K 3/12* (2006.01)

(52) U.S. Cl.
CPC ..... *A47K 3/127* (2013.01)

(58) Field of Classification Search
CPC ..... A47K 3/127; A47K 3/125; A47K 3/12
USPC ..... 4/572.1
See application file for complete search history.

(56) References Cited

U.S. PATENT DOCUMENTS

| | | | | |
|---|---|---|---|---|
| 6,507,959 | B1 * | 1/2003 | Sundberg | A47K 3/127 4/584 |
| 7,430,769 | B2 * | 10/2008 | Davis | A47K 3/024 4/578.1 |
| 7,926,135 | B1 | 4/2011 | Leach | |
| D1,059,862 | S * | 2/2025 | Chen | D6/333 |
| 2008/0155743 | A1 | 7/2008 | Allen | |
| 2014/0182057 | A1 * | 7/2014 | Saidman | A47K 3/127 4/572.1 |

* cited by examiner

*Primary Examiner* — Huyen D Le

(57) ABSTRACT

An auxiliary support bar for a bathtub includes: a first bar having opposite ends that are detachably connectable to two sidewalls of the bathtub; and a second bar having a top end that is connected to the first bar. The first bar and the second bar are shaped and sized to form at least one through hole with a bottom of the bathtub for the legs of a baby to pass through.

6 Claims, 4 Drawing Sheets

AUXILIARY SUPPORT BAR FOR BATHTUB AND BATHTUB HAVING THE SAME

CROSS REFERENCE TO RELATED APPLICATIONS

This application claims priority to Chinese Patent Application No. CN 202520176229.4, filed Jan. 26, 2025, which is hereby incorporated by reference herein as if set forth in its entirety.

TECHNICAL FIELD

The present disclosure generally relates to bathtubs, and in particular relates to a foldable baby bath support device.

BACKGROUND

For most families, especially those with children, a bathtub is necessary because conventional bathtubs in bathrooms are too large for children. When bathing young children in a bathtub, it is necessary to keep them in a sitting position, which often requires an adult to hold the child with one hand, leaving only one hand free to wash the child. This can be quite inconvenient

BRIEF DESCRIPTION OF DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
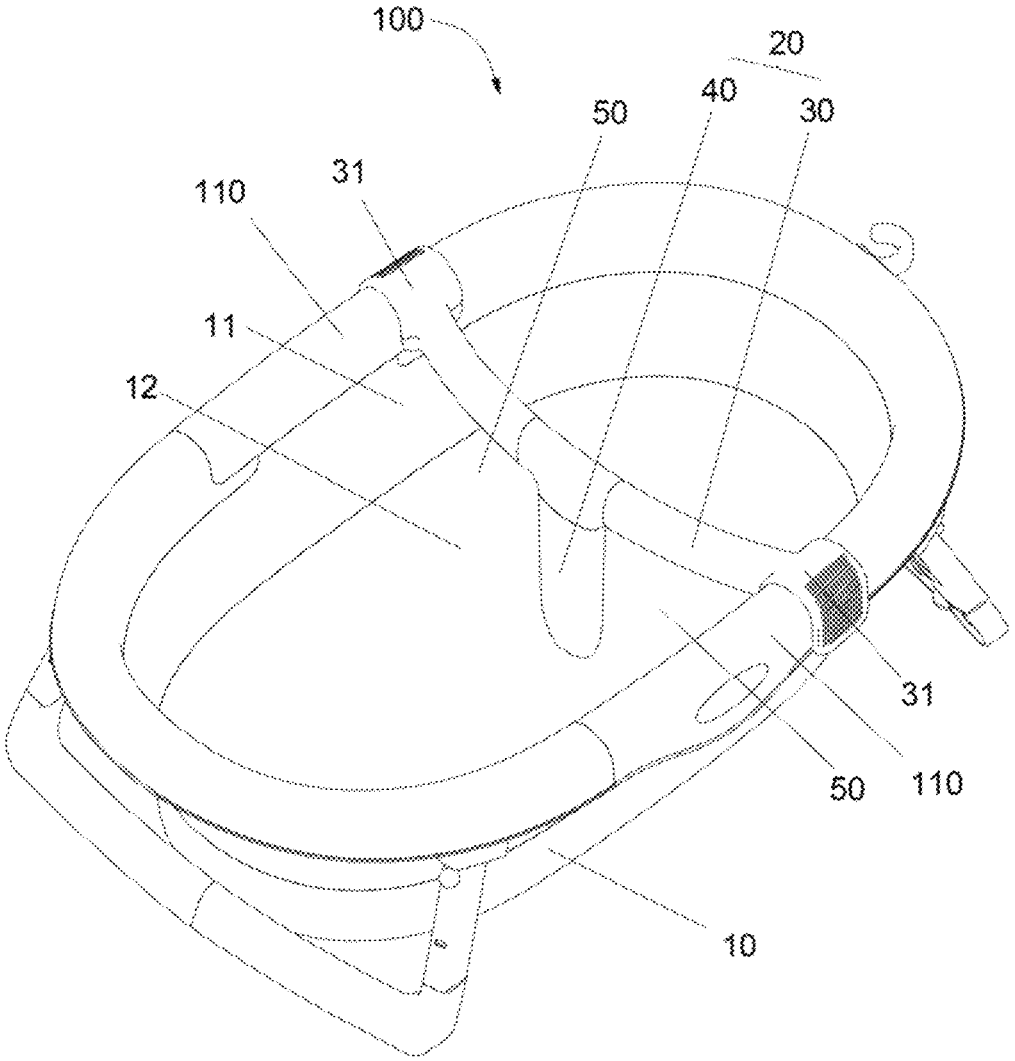
FIG. 1 is a schematic isometric view of a bathtub assembly according to one embodiment.
Figure 2:
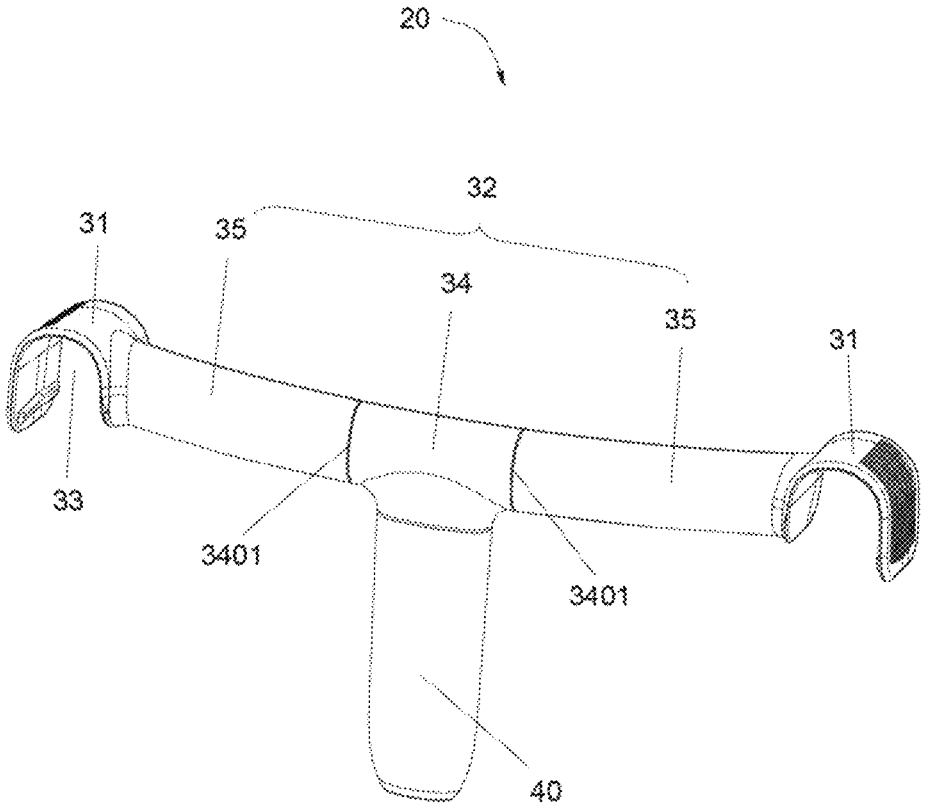
FIG. 2 is a schematic isometric view of an auxiliar support bar according to one embodiment.
Figure 3:
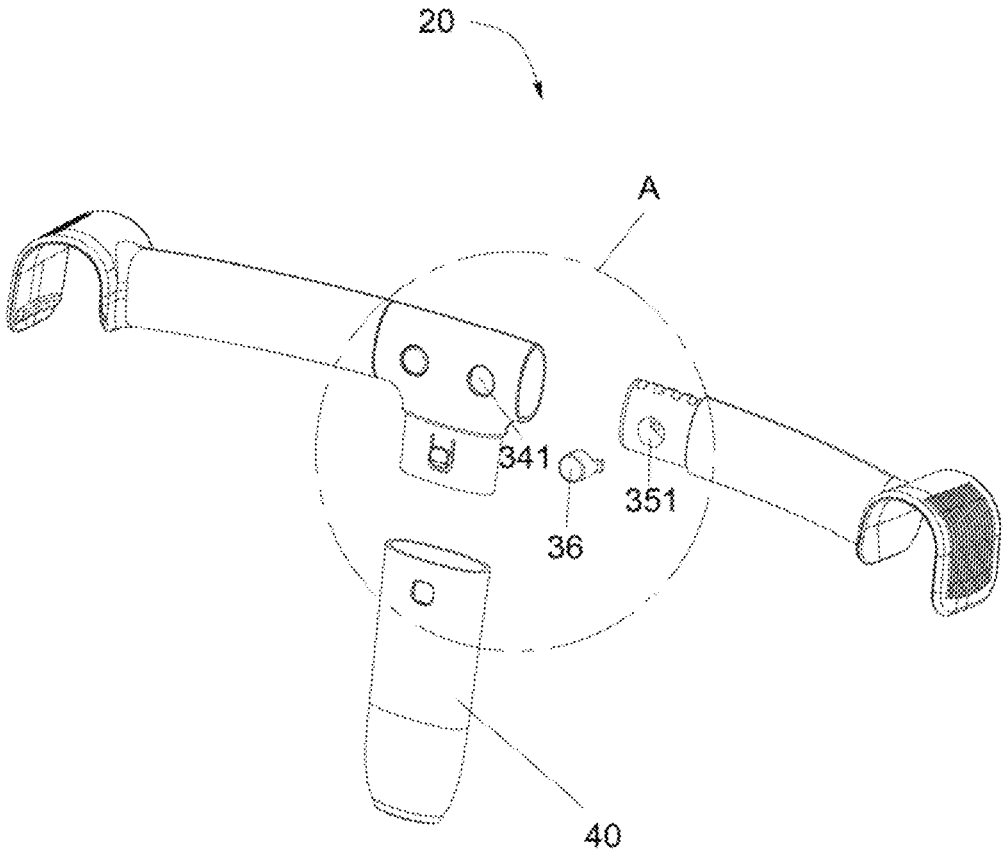
FIG. 3 is schematic isometric exploded view of the auxiliary support bar according to one embodiment.
Figure 4:
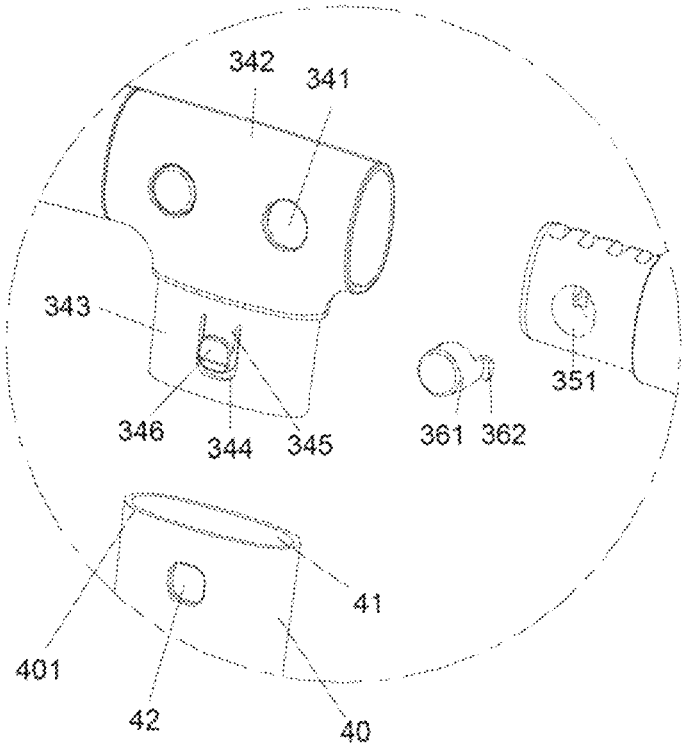
FIG. 4 is an enlarged view of a portion A of FIG. 3.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

Referring to FIGS. 1-4, in one embodiment, a bathtub assembly 100 includes a bathtub 10 and an auxiliary support bar 20 that is detachably connectable to the bathtub 10. For young children, in order to ensure their sitting posture during bathing, the auxiliary support bar 20 can be connected to the bathtub 10. At this time, the auxiliary support bar 20 and the bottom and side walls of the bathtub 10 form a space that can just accommodate the young child. In this way, the young child can lean against a side wall of the bathtub 10 and be restricted by the auxiliary support bar 20, so that the young child can maintain a sitting posture. When not in use, the auxiliary support bar 20 can be removed from the bathtub 10, especially for a bathtub that can be folded in half. That is, after removing the auxiliary support bar 20, the bathtub can be folded in half, so that the required storage space can be reduced.

With the above configuration, by connecting the auxiliary support bar 20 to the bathtub 10, a space just large enough to accommodate a child can be formed using the auxiliary support bar 20 and the bottom and side walls of the bathtub 10, so that the child can maintain a sitting position during bathing.

In one embodiment, the auxiliary support bar 20 includes a first bar 30 and a second bar 40. The first bar 30 has two connecting portions 31 at opposite ends, and the connecting portions 31 are to detachably connect the first bar 30 to the two sidewalls 11 of the bathtub 10. The top end 401 of the second bar 40 is connected to the first bar 30, and the first bar 30 and the second bar 40 are configured to form one or two through holes 50 with the bottom 12 of the bathtub 10 for the two legs of the child to pass through.

In one embodiment, the first bar 30 and the second bar 40 are generally T-shaped as a whole, that is, the first bar 30 is approximately perpendicular to the second bar 40.

In one embodiment, the first bar 30 includes a body 32, and the two connecting portions 31 are formed at opposite ends of the body 32. Each connecting portion is an arc-shaped wall formed with a groove 33, and the groove 33 is shaped and sized to allow the connecting portion 31 to be snapped onto the top end 110 of the sidewall 11 of the bathtub 10. In this embodiment, the top ends 110 of the sidewalls 11 of the bathtub 10 are arc-shaped, and the shape of the grooves 33 are shaped and sized to fit the top ends 110 of the sidewall 11, which is close to a semicircle. With such a structure, the top ends 110 of the sidewalls 11 of the bathtub 10 can be just accommodated in the grooves 33. In addition, the arc-shaped wall forming the groove 33 is a thin wall, so that the arc-shaped wall can be slightly deformed. In this way, after the connecting portions 31 are connected to the sidewall 11 of the bathtub 10, the arc-shaped walls are supported by the top ends 110 of the sidewall 11 and slightly deformed, so that the connecting portions 31 can be firmly fixed to the top ends 110 of the sidewall 11 of the bathtub 10.

In one embodiment, the two connecting portions 31 are respectively connected to the two opposite sidewalls 11 of the bathtub 10, so that the first bar 30 extends from one sidewall 11 of the bathtub 10 to the other sidewall 11 opposite to the sidewall 11. At this time, as shown in FIG. 1, the auxiliary support bar 20, together with the bottom and sidewalls of the bathtub 10, form a small space to restrict the movement of the young child. The young child will be restricted by the auxiliary support bar 20 and the sidewalls of the bathtub 10 and will not fall over and cause danger.

It is understandable that the means of detachably connecting the first bar 30 to the bathtub 10 is not limited to the above embodiment, and a suitable connection means can be selected from conventional connection techniques according to actual needs.

In one embodiment, the body 32 includes an intermediate connecting member 34 and two connecting bars 35 connected to the left and right ends 3401 of the intermediate connecting member 34, and the two connecting portions 31 and the connecting bars 35 are integrally formed (for example, by injection molding).

In one embodiment, the left and right ends 3401 of the intermediate connecting member 34 are both open ends, and the ends of the connecting bars 35 opposite to the connecting portions 31 are received in the left and right ends of the intermediate connecting member 34, and then connected together by fasteners. In one embodiment, each fastener 36 includes a body 361 and a hook 362 extending from the end of the body 361. The left and right ends 3401 of the intermediate connecting member 34 are both provided with through holes 341, and the ends of the connecting bars 35 opposite to the connecting portions 31 are provided with a receiving hole 351. After the ends of the connecting bars 35 opposite to the connecting portions 31 are received in the left and right ends 3401 of the intermediate connecting member 34, the through holes 341 are aligned with the receiving holes 351, and a user can insert the fasteners 36 into the receiving hole 351*s* after passing through the through holes 341 until the hooks 362 hook one end of each receiving hole 351. In this way, the connecting bars 35 are detachably connected to the intermediate connecting member 34.

In one embodiment, the top end 401 of the second bar 40 is detachably connected to a bottom of the intermediate connecting member 34. Specifically, the intermediate connecting member 34 is roughly T-shaped, having hollow left and right transverse member 342 and a vertical member 343 substantially perpendicularly connected to the transverse member 342. The vertical member 343 is hollow, and a through hole 344 is provided in its surface. A cantilever elastic tab 345 is formed in the through hole 344, and a protrusion 346 is formed on the free end of the elastic tab 345. A receiving chamber 41 is defined in the top end 401 of the second bar 40, and a through hole 42 is formed on the sidewall of the receiving chamber 41. The bottom of the intermediate connecting member 34 (i.e., the vertical member 343) is received in the receiving chamber 41, and the protrusion 346 is received in the through hole 42, so that the second bar 40 is detachably connected to the intermediate connecting member 34.

With the above-mentioned structure, the first bar 30 itself and the first bar 30 and the second bar 40 can be conveniently assembled together and can be easily disassembled when necessary.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. An auxiliary support bar for a bathtub comprising:

a first bar having opposite ends that are detachably connectable to two sidewalls of the bathtub; and a second bar having a top end that is connected to the first bar, wherein the first bar and the second bar are configured to form at least one through hole with a bottom of the bathtub for legs of a baby to pass through;

wherein the first bar comprises a body and two connecting portions arranged at opposite ends of the body, and each of the connecting portions is an arc-shaped wall defining a groove, and the grooves are configured to allow the connecting portions to be engaged with top ends of the sidewalls of the bathtub;

wherein the body comprises an intermediate connecting member and two connecting bars connected to a left end and a right end of the intermediate connecting member, and the two connecting bars and the connecting portions are integrally formed;

wherein the top end of the second bar is detachably connected to the intermediate connecting member;

wherein the top end of the second bar defines a receiving chamber having a sidewall that defines a through hole, the intermediate member comprises a vertical member that comprises an elastic tab, the elastic tab comprises a protrusion, the vertical member is received in the receiving chamber, the protrusion is received in the through hole of the sidewall of the receiving chamber, thereby detachably connecting the second bar to the intermediate member.

2. A bathtub assembly comprising:

a bathtub having two sidewalls; and an auxiliary support bar comprising:

a first bar having opposite ends that are detachably connectable to the two sidewalls of the bathtub; and a second bar having a top end that is connected to the first bar, wherein the first bar and the second bar are configured to form at least one through hole with a bottom of the bathtub for legs of a baby to pass through;

wherein the top end of the second bar defines a receiving chamber having a sidewall that defines a through hole, the first bar comprises a vertical member that comprises an elastic tab, the elastic tab comprises a protrusion, the vertical member is received in the receiving chamber, the protrusion is received in the through hole of the sidewall of the receiving chamber, thereby detachably connecting the second bar to the first bar.

3. The bathtub assembly of claim 2, wherein the first bar comprises a body and two connecting portions arranged at opposite ends of the body, and each of the connecting portions is an arc-shaped wall defining a groove, and the grooves are configured to allow the connecting portions to be engaged with top ends of the sidewalls of the bathtub.

4. The bathtub assembly of claim 3, wherein the body comprises an intermediate connecting member and two connecting bars connected to a left end and a right end of the intermediate connecting member, and the two connecting bars and the connecting portions are integrally formed.

5. The bathtub assembly of claim 4, wherein the top end of the second bar is detachably connected to the intermediate connecting member, and the intermediate connecting member comprises the vertical member.

6. A bathtub assembly comprising:

a bathtub having two sidewalls; and an auxiliary support bar comprising:

a first bar having opposite ends that are detachably connectable to the two sidewalls of the bathtub; and a second bar having a top end that is connected to the first bar, wherein the first bar and the second bar are configured to form at least one through hole with a bottom of the bathtub for legs of a baby to pass through;

wherein the top end of the second bar defines a receiving chamber, the first bar comprises a vertical member, the vertical member is received in the receiving chamber, the vertical member is detachably connected to a sidewall of the receiving chamber in a snap-fit manner, thereby detachably connecting the second bar to the first bar.

* * * * *